United States Patent [19]

Cervantes

[11] Patent Number: 4,982,516

[45] Date of Patent: Jan. 8, 1991

[54] ADJUSTABLE IRONING TABLE COVER

[75] Inventor: Ignacio Cervantes, Henry Ford, Mexico

[73] Assignee: Cia, Manufacturera Erc, S.A., de C.V., Mexico, Mexico

[21] Appl. No.: 443,863

[22] Filed: Nov. 30, 1989

Related U.S. Application Data

[63] Continuation of Ser. No. 294,462, Jan. 6, 1989, abandoned.

[51] Int. Cl.[5] ..... D06F 83/00

[52] U.S. Cl. ..... 38/140; 108/90

[58] Field of Search ..... 150/158, 165; 2/275

[56] References Cited

U.S. PATENT DOCUMENTS

| | | | |
|---|---|---|---|
| 1,208,643 | 12/1916 | Poll | 38/140 |
| 1,832,545 | 11/1931 | Grant | 38/140 |
| 1,885,737 | 1/1932 | Lewis | 38/140 X |
| 2,663,958 | 12/1953 | Keast | 38/140 X |
| 2,814,135 | 11/1957 | Freeman | 38/140 X |
| 4,360,984 | 11/1982 | Ruttenberg | 38/66 |
| 4,603,494 | 8/1986 | Lehrman | 38/140 |
| 4,627,363 | 12/1986 | Jones | 108/90 |
| 4,642,914 | 2/1987 | Caldeira | 2/DIG. 6 |
| 4,700,406 | 10/1987 | Meisfrell | 2/DIG. 6 |
| 4,705,084 | 11/1987 | Rodebaugh et al. | 2/275 |
| 4,813,166 | 3/1989 | Drake | 38/140 |

FOREIGN PATENT DOCUMENTS

| | | | |
|---|---|---|---|
| 453100 | 9/1936 | United Kingdom | 38/140 |
| 1173464 | 12/1969 | United Kingdom | 38/140 |

*Primary Examiner*—Andrew M. Falik

*Attorney, Agent, or Firm*—Oblon, Spivak, McClelland, Maier & Neustadt

[57] ABSTRACT

An ironing table covers, particularly a one-size adjustable cover adaptable to different sizes of boards by use of pressure sensitive tapes and by use of a pull string to permit the cover to be easily adjusted and tucked-in. The cover includes a nose portion which can be folded back to extend under the ironing board so that the pressure tapes of the nose portion can be engaged with other portions of the cover so as to secure the cover to the board.

5 Claims, 3 Drawing Sheets

ADJUSTABLE IRONING TABLE COVER

This application is a continuation of application Ser. No. 07/294,462, filed on Jan. 6, 1989, now abandoned.

BACKGROUND OF THE INVENTION

1. Field of the Invention

The present invention is related to ironing table covers, particularly to a one-size adjustable covers to be adapted to different sizes of boards by pressure sensitive tapes and by a pull string to permit the cover to be easily adjusted and tucked-in to the size of the ironing board.

2. Discussion of the Prior Art

There have been in the market for a long time numerous makes and manufacturers of ironing boards who produce different sizes of products, and that offer them with or without a cover as well as manufacturers of covers, who market them in specific sizes according to different types and manufacturers. It is very frecuent that a housewife wishing to replace her ironing table cover does not have in mind the size of the particular cover for the board at home, resulting in frecuent errors because of the acquired article is bigger or smaller than the one needed. It is to be noted that presently there are many varieties of materials, with or without heat insulation, with or without padding, but there is not one available that can be fitted or adjusted to all the sizes of ironing tables presently available in the market.

One of the most important objectives of the present invention is to finish once and for all with the problem of making mistakes in purchasing the appropiate size of ironing table covers, by offering a "one size fits all" standard cover.

Another objective of the present invention is to facilitate stocking of different sizes of ironing table covers to the warehouses and retailers, by keeping only one size of ironing table covers in stock.

Still another objective of the present invention is to allow the warehouses and retailers to diminish their stock of ironing board covers by keeping only one size in stock which results in a considerable economy.

DESCRIPTION OF THE INVENTION

Figure 1:
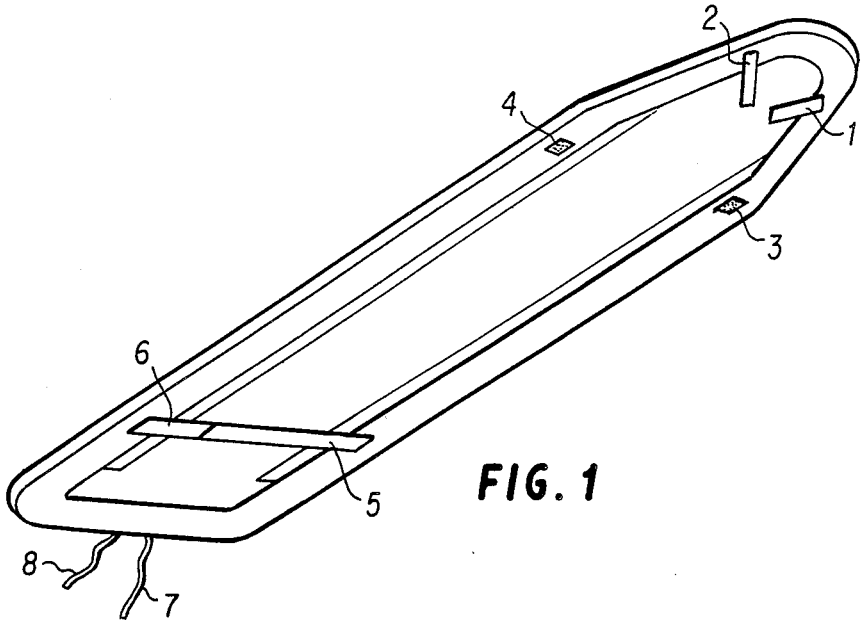
FIG. 1—this figure represents an ironing table cover, as installed, in a conventional perspective.
Figure 2:
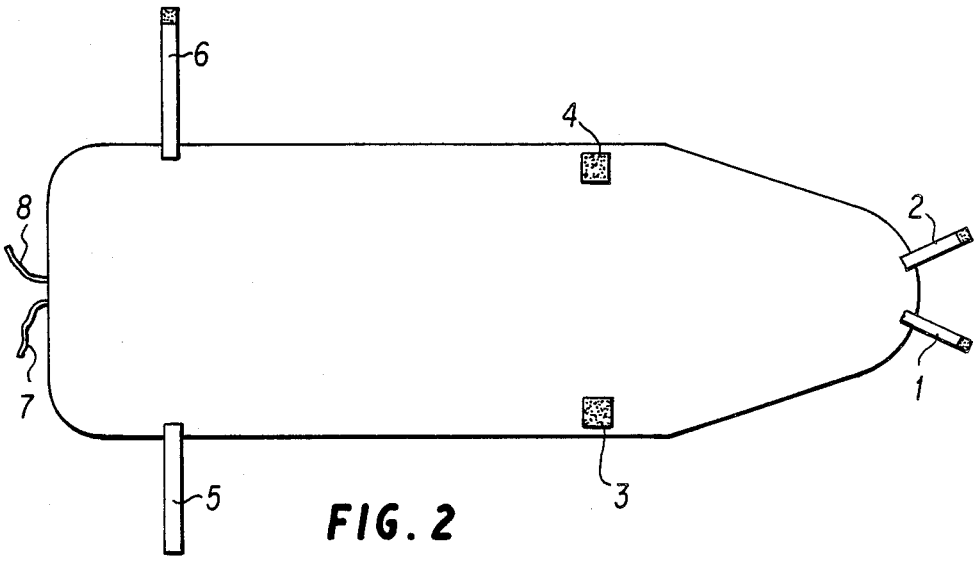
FIGS. 2—presents a top view of the ironing table cover completely extended.
Figure 3A:
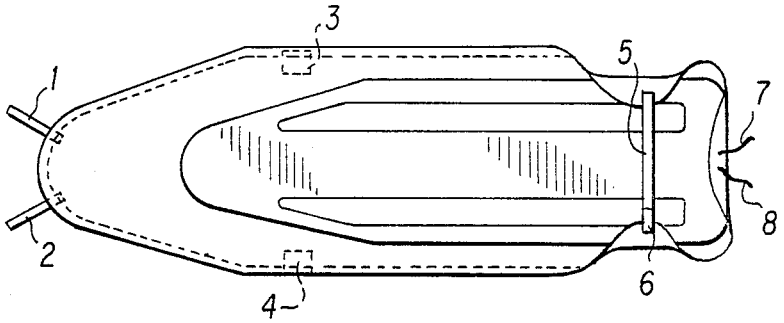
FIGS. 3*a–c*—shows an ironing table cover being fit in steps a-b-c to a small ironing table.
Figure 3B:
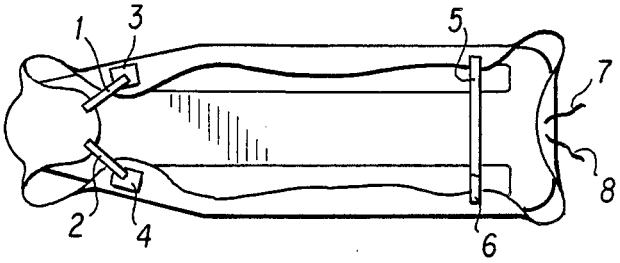
Figure 3C:
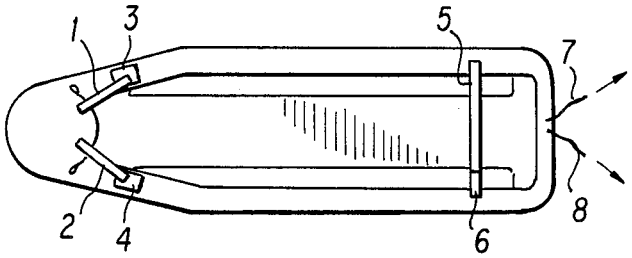
Figure 4A:
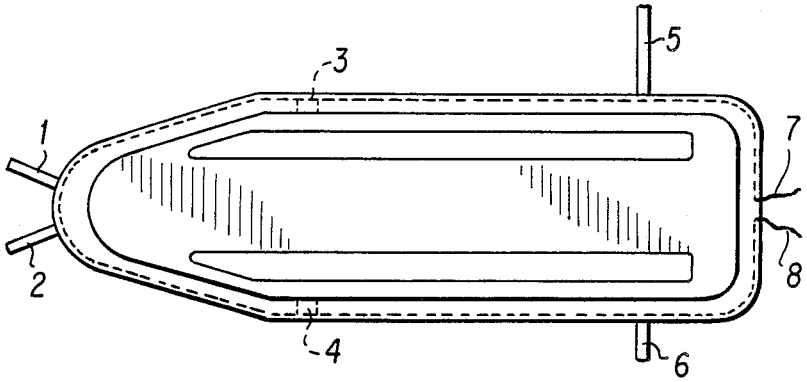
FIGS. 4*a–c*—shows an ironing table cover being fit in steps a-b-c to a big ironing table.
Figure 4B:
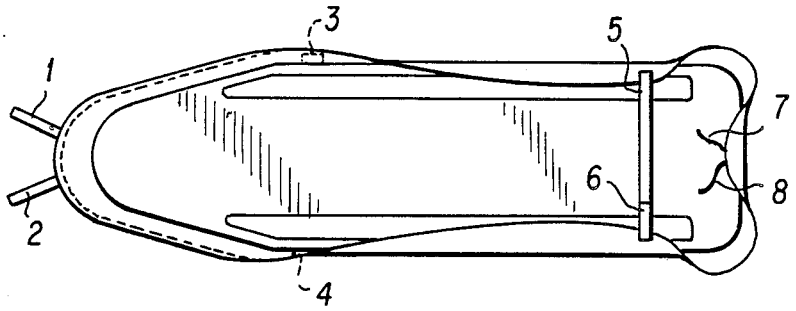
Figure 4C:
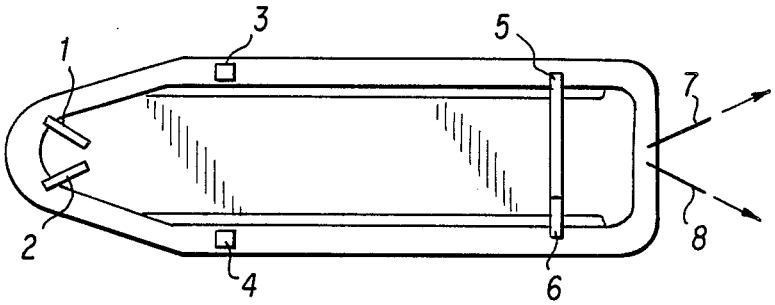

The present invention relates to ironing table covers, more particularly it refers to adjustable covers to fit different size ironing tables. A cover consists of a rounded nose portion with front securing members near an apex thereof, rectangular side portions which include further securing members, and a rear portion having drawstrings exiting therefrom. It further consists of a piece of cloth with overlocked edges, of about 60" by 19" with a drawstring around all its perimeter, which is made out of cotton in its preferred form and has an approximate diameter of 0.125", and is provided with pressure sensitive tapes to maintain said cover tucked-in when in place; it is manufactured of a heat resistant, soft and pliable material, such as cotton, which is assembled in place as follows:

The cover is positioned extended on top of the ironing table as shown in FIG. 2 with pressure sensitive tape tips 1 and 2, towards the nose or narrow end of the table, and the pressure sensitive tape tips 5 and 6, as well as the ends of the string 7 and 8, towards the wide rectangular side and rear end of the table.

The cover is then folded snuggly to the underside of the ironing table starting at the wide rectangular end of the table. Securing one tip of the pressure sensitive tape 5 over the other 6 which holds the counterpart of the pressure sensitive tape, next folding the other end of the cover under the narrow end of the table fitting it snuggly by pulling both tips 1 and 2 of the pressure sensitive tape and pressing them into their counter-part press-sensitive pads 3 and 4, so as to obtain a good fit; and finally pulling the loose ends 7 and 8 of the strings tightly to obtain a smooth and snug fit all around the edges of the ironing table and keeping them in that position by tying a knot with both ends.

EXAMPLES OF THE PREFERRED EMBODIMENTS OF THE INVENTION

Example 1—this example shows the effectiveness of utilizing the cover on a 44 to 49 inch ironing table, which lies in the range of short ironing tables, and which can be folded neatly regardless of the extra material, by positioning it on top of the ironing table as shown in FIG. 2 with pressure sensitive tape tips 1 and 2, towards the nose or narrow end of the table, and the pressure sensitive tape tips 5 and 6, as well as the ends of the string 7 and 8, towards the wide rectangular end of the table.

The cover is then folded snuggly to the underside of the ironing board starting at the wide rectangular end of the table. Securing one tip of the pressure sensitive tape 5 over the other 6 which holds the counter-part of the pressure sensitive tape, next folding the other end of the cover under the narrow end of the table fitting it snuggly by pulling both tips 1 and 2 of the pressure sensitive tape and pressing them into their counter-part press-sensitive pads 3 and 4, so as to obtain a good fit; and finally pulling the loose ends 7 and 8 of the strings tightly to obtain a smooth and snug fit all around the edges of the ironing table and keeping them in that position by tying a knot with both ends.

Example 2—this example demonstrates the utilization of the cover on a 50 to 55 inch ironing board, which is in the range of long ironing boards, by positioning it on top of the ironing table as shown in FIG. 2 with pressure sensitive tape tips 1 and 2, towards the narrow end of the table, and the pressure sensitive tape tips 5 and 6, as well as the ends of the string 7 and 8, towards the wide rectangular end of the table.

The cover is then folded snuggly to the underside of the ironing board starting at the wide rectangular end of the table. Securing one tip of the pressure sensitive tape 5 over the other 6 which holds the counterpart of the pressure sensitive tape, next folding the other end of the cover under the narrow end of the table and pulling the loose ends 7 and 8 of the strings tightly to obtain a smooth and snug fit all around the edges of the ironing table and keeping them in that position by tying a knot with both ends.

While the invention has been described in terms of the preferred embodiments, the foregoing description should be taken as illustrative and not in a limiting sense.

What is claimed is:

1. An adjustable ironing board cover, which comprises:

a cloth having a rounded nose portion, substantially rectangular side and rear portions and a hem continuously bordering a perimeter portion of the cloth along the rounded nose and rectangle side portions;

a drawstring fitted within said hem to exit at the rear portion; and a plurality of securing members located near an apex portion of said rounded nose portion of said cloth and along said side portions, wherein, when the ironing board cover is fitted on a board shorter than said cover said nose portion is dimensioned so as to extend forward of a nose portion of the ironing board, so that said cover nose portion is adapted to be folded back so as to extend under the ironing board toward the rear portion such that said apex portion securing members are engageable with the securing members of said side portions so as to secure said cover to said board.

2. The adjustable ironing table cover as set forth in claim 1 wherein said cloth is overlocked and hemmed around its peripheral edges so as to form a passage for said drawstring.

3. The adjustable ironing board as set forth in claim 2 wherein said drawstring comprises cotton.

4. The adjustable ironing table cover as set forth in claim 1 wherein said securing member comprise pressure-sensitive-tape sets of the type wherein a first element contains hooks and a counter-part second element contains loops so that said first and second elements adhere to each other when pressed together.

5. The adjustable ironing table cover as set forth in claim 4 wherein said cloth can be fitted to different sizes of ironing tables by being folded underneath, held in place by means of said pressure sensitive tapes, and tightening by pulling said drawstring.

* * * * *